US007414619B2

(12) United States Patent
Kim

(10) Patent No.: US 7,414,619 B2
(45) Date of Patent: Aug. 19, 2008

(54) DISPLAY UNIT AND CONTROL METHOD THEREOF

(75) Inventor: Young-chan Kim, Yeuiwang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 658 days.

(21) Appl. No.: 10/929,679

(22) Filed: Aug. 31, 2004

(65) Prior Publication Data

US 2005/0062735 A1 Mar. 24, 2005

(30) Foreign Application Priority Data

Sep. 23, 2003 (KR) ..... 10-2003-0065961

(51) Int. Cl.
*G09G 5/00* (2006.01)

(52) U.S. Cl. ..... 345/204; 345/1.1; 345/530; 345/536; 345/543; 345/544

(58) Field of Classification Search ..... 345/1.1, 345/2.1, 204, 211, 530, 536, 543, 544; 348/555, 348/556

See application file for complete search history.

(56) References Cited

U.S. PATENT DOCUMENTS 4,484,218 A * 11/1984 Boland et al. ..... 725/131
5,315,708 A * 5/1994 Eidler et al. ..... 711/119
5,828,841 A * 10/1998 Ito et al. ..... 725/116
6,300,980 B1 * 10/2001 McGraw et al. ..... 348/552
2001/0004257 A1 * 6/2001 Nitta et al. ..... 345/211
2003/0004930 A1 * 1/2003 Minder et al. ..... 707/2
2003/0025685 A1 * 2/2003 Shirasaki et al. ..... 345/204
2003/0071802 A1 * 4/2003 Sendelweck et al. ..... 345/204

FOREIGN PATENT DOCUMENTS

CN 1175050 3/1998

(Continued)

OTHER PUBLICATIONS

Michael B. Bergamasco, Optical device which sends image signal to CPU for storage: GB 2 351 408; Pub. Date Dec. 27, 2000.*

(Continued)

*Primary Examiner*—Bipin Shalwala
*Assistant Examiner*—Vince E Kovalick
(74) *Attorney, Agent, or Firm*—Staas & Halsey LLP

(57) ABSTRACT

A control method to control a display unit in which a video signal is supplied by an external device to display the video signal, the control method including: dividing EDID information of the display unit in essential EDID information that is required to display the video signal and non-essential EDID information excluding the essential EDID information; and storing the essential EDID information in a non-changeable memory and at least a part of the non-essential EDID information in the changeable memory.

10 Claims, 3 Drawing Sheets

FOREIGN PATENT DOCUMENTS

| | | |
|---|---|---|
| JP | 11-57591 | 3/1999 |
| JP | 2001-356752 | 12/2001 |
| JP | 2002-194346 | 7/2002 |
| KR | 0132343 | 12/1998 |
| KR | 1999-31121 | 5/1999 |
| KR | 1999-57591 | 7/1999 |
| KR | 2002-74347 | 9/2002 |
| KR | 2003-07183 | 1/2003 |
| KR | 2003-58399 | 7/2003 |

OTHER PUBLICATIONS

Michael B. Bergamasco, Optical device which sends image signal to CPU for storage: GB 2 351 408: Pub. Date Dec. 27, 2000 GB 2 351 408.*

Chinese Office Action issued Jan. 26, 2007 in corresponding Chinese Patent Application No. 2004100782471 (5 pages).

* cited by examiner

DISPLAY UNIT AND CONTROL METHOD THEREOF

CROSS-REFERENCE TO RELATED APPLICATIONS

This application claims the benefit of Korean Patent Application No. 2003-65961, filed on Sep. 23, 2003, in the Korean Intellectual Property Office, the disclosure of which is incorporated herein by reference.

BACKGROUND OF THE INVENTION

1. Field of the Invention

The present invention relates to a display unit and a control method thereof, and, more particularly, to a display unit having a non-changeable memory and a changeable memory to separately store extended display identification (EDID) information by dividing the EDID information and a control method thereof.

2. Description of the Related Art

Extended display identification (EDID) information is information to identify a display unit and includes a variety of information required to identify the display unit.

For example, the EDID information may comprise display information such as an EDID header, a manufacturer identifying code, a product identifying code, a manufacturing date, a EDID structure version, a basic display variable and a property, a color property, timing information and a checksum byte to detect an error.

The EDID information is stored in an electrically erasable programmable read only memory (EEPROM) by a manufacturing process and is stored as one of analog data and digital data according to a video signal supplied from an external device.

When a user turns on the display unit, the EDID information stored in the EEPROM is read by a microcontroller unit and the EDID information stored in the EEPROM is tested for whether the EDID information has an error.

The error is determined by testing whether a result of an addition of the EDID bytes is equal to 0. That is, if the addition of the EDID bytes is equal to 0 without an overflow, an error is determined to have not occurred. A value of the checksum byte is previously set to make the result of the addition of the EDID bytes equal to 0 and the checksum byte is included in the EDID information to be stored.

Thus, if the result of the addition of the EDID bytes is equal to 0, the EDID information is determined to not have an error. Otherwise, the error is determined to have occurred in the EDID information or when the microcontroller unit reads the EDID information.

If the EDID information is determined to not have the error, the microcontroller unit of the display unit stores the EDID information stored in the EEPROM in a random access memory (RAM) to make the EDID information stored in the EEPROM accessible by an external device.

If a conventional computer is booted, an operating system (OS) of the computer reads out the EDID information from the RAM of the display unit through a plug and play (PnP) and installs a driver that is proper for the display unit.

For the PnP, a display data channel (DDC) that is proposed as a standard by video electronics standards association (VESA) is selected as a communication standard for a communication between the display unit and a computer main body. The DDC standard includes a DDC 1 standard supporting a one-way transmission and a DDC 2B standard, a DDC 2AB standard and a E-DDC standard supporting a two-way transmission, thereby enabling a communication between the computer main body and the display unit.

However, in the conventional computer, if an error occurs and incorrect EDID information is input in the computer main body, the display unit cannot display a picture. Moreover, a long time is required to store the EDID information in the EEPROM by the manufacturing process.

SUMMARY OF THE INVENTION

Accordingly, it is an aspect of the present invention to provide a display unit having a non-changeable memory and a changeable memory to separately store EDID information by dividing the EDID information and a control method thereof.

Additional aspects and/or advantages of the invention will be set forth in part in the description which follows and, in part, will be obvious from the description, or may be learned by practice of the invention.

The above and/or other aspects are achieved by providing a control method of a display unit in which a video signal is supplied by an external device to display the video signal, the control method comprising: dividing EDID information of the display unit into first EDID information (i.e., essential or necessary EDID information) that is required to display the video signal and second EDID information (i.e. optional, unnecessary or non-essential EDID information) which excludes the first EDID information; and storing the first EDID information in a non-changeable memory and at least a part of the second EDID information in the changeable memory.

According to an aspect, the control method of a display unit further comprises: dividing the second EDID information into common second EDID information that is common in displays having a common specification and particular second EDID information that is particular for each of the display units, the common second EDID information being stored in non-changeable memory.

According to an aspect, the control method of a display unit further comprises: providing a controller; detecting an error of the first and second EDID information stored in the changeable memory and the non-changeable memory by the controller; and supplying the first and second EDID information stored in the non-changeable memory to the external device, if the error is detected.

According to an aspect, the control method of a display unit further comprises: supplying all of the EDID information stored in the non-changeable memory and the changeable memory to the external device, if no error is detected.

According to an aspect, the non-changeable memory is a read only memory (ROM) and the changeable memory is EEPROM.

The above and/or other aspects of the present invention are achieved by providing a display unit in which a video signal is supplied by an external device to display the video signal, the display unit comprising: an non-changeable memory to store a first (i.e., essential) EDID information that is required to display the video signal; and a changeable memory to store at least a part of second (i.e., optional, unnecessary or non-essential) EDID information which excludes the first EDID information.

According to an aspect, the non-changeable memory stores common second EDID information common in display units having a common specification among the second (i.e., optional, unnecessary or non-essential) EDID information.

According to an aspect, the control method of a display unit further comprises: a controller determining whether the first and second EDID information stored in the non-changeable memory and the changeable memory, respectively, has an error and supplying the first EDID information stored in the non-changeable memory to the external device, if an error is detected.

According to an aspect, the controller supplies all first and second EDID information stored in the non-changeable memory and the changeable memory to the external device, if no error is detected.

BRIEF DESCRIPTION OF THE DRAWINGS

The above and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
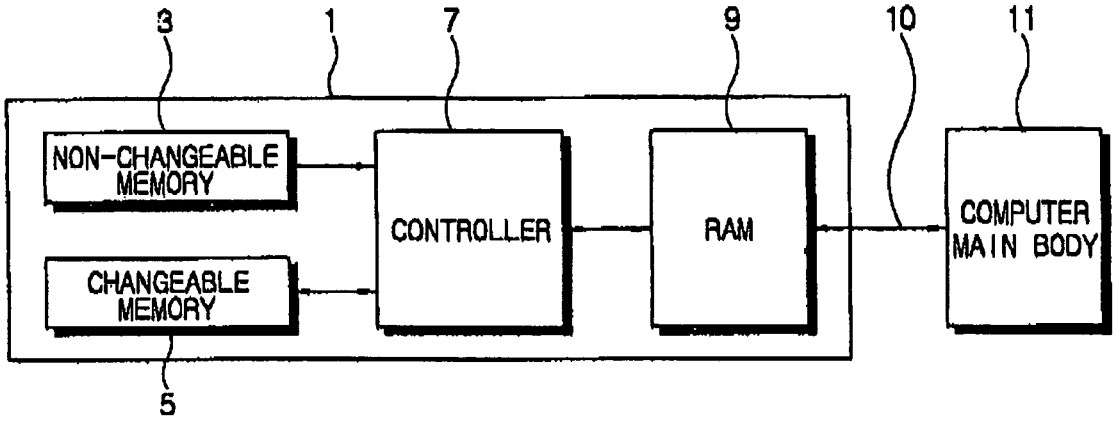
FIG. 1 is a block diagram of a structure of a display unit according to a first embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

FIG. 1 is a block diagram of a structure of a display unit according to a first embodiment of the present invention.

As shown in FIG. 1, a display unit 1 comprises a non-changeable memory 3, a changeable memory 5, a controller 7 and a random access memory (RAM) 9, and is connected to a computer main body 11.

The non-changeable memory 3 is a memory in which stored information cannot be changed.

A read only memory (ROM) generally installed in a micro controller unit may be used as the non-changeable memory 3. The ROM (i.e., non-changeable memory 3) is used to store important information that should not be changed for a system to properly operate.

To stably operate the system connected to the computer main body 11, a first (i.e. essential or necessary) EDID information that is required, at a minimum, to display video information may be stored in the ROM 3.

Moreover, for a fast manufacturing operation of the display unit 1, common second (i.e., optional, unnecessary or non-essential) EDID information (i.e., detailed information common to display units having a common specification) may be stored in the ROM 3 together with the first EDID information.

The changeable memory 5 is a memory in which information is deletable and changeable. However, to prevent the stored information from being easily changed by a user of the display unit 1, electronically erasable programmable read only memory (EEPROM) may be used as the changeable memory 5.

An entirety or a part of the second (i.e., optional, unnecessary or non-essential) EDID information which includes the common second EDID information and particular second EDID information is stored in the changeable memory 5. Further, the common second EDID information described above may be stored in the non-changeable memory 3 and the particular second EDID information that is the particular to the display unit 1 may be stored in the changeable memory 5.

The EDID information, which is stored in the ROM 3, is storable collectively in display units of a common kind, but the particular second EDID information, which is stored in the changeable memory 5, should be individually stored in each of the display units as particular information.

The controller 7 detects errors that may occur in an operation of storing EDID information in the non-changeable or changeable memory 3 or 5 and in an operation of supplying the EDID information to the computer main body 11, and detects errors of the EDID information and supplies correct EDID information to an external device to display video information on the display unit 1. The controller 7 may be a microcontroller unit operated by proper software.

The RAM 9 is a temporary memory in which the EDID information is stored to exchange the EDID information with the computer main body 11.

The computer main body 11 is connected to the display unit 1 through a connector 10 and exchanges the EDID information with the display unit 1. The computer main body 11 is used to store the EDID information in the non-changeable and changeable memories 3 and 5 in the manufacturing operation and reads the EDID information from the display unit 1 to initialize a system for use thereof, as one of the plug and play (Pnp) operations.

A D-sub connector or a digital visual interface (DVI) connector may be used as the connector 10 connecting the computer main body 11 and the display unit 1. The connector 10 is selected according to a type of video information supplied from the computer main body 11 to the display unit 1. The D-sub connector is used for analog video information and the DVI connector is used for digital video information. If the display unit 1 supplies both analog and digital video information, both of the D-sub connector and the DVI connector may be connected to the computer main body 11, respectively, and/or a DVI-I connector that provides for both of analog/digital specifications may be used.

Further, descriptions of how to control the display unit 1 shown in FIG. 1 in the manufacturing operation and in a use thereof are provided below.

Figure 2:
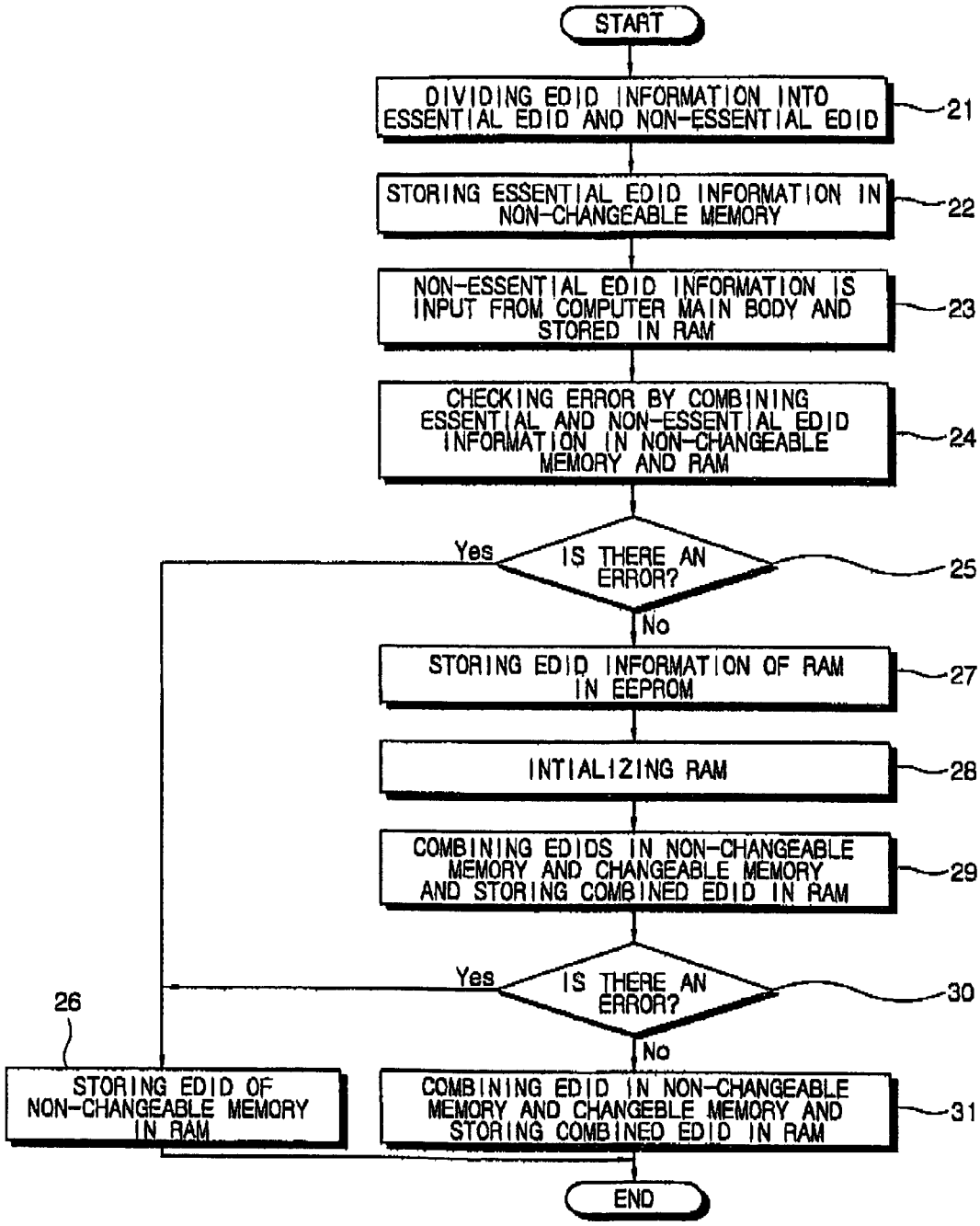
FIG. 2 is a flow chart of a manufacturing operation for a display unit according to a second embodiment of the present invention.

FIG. 2 is a flow chart of the display unit 1 according to a second embodiment of the present invention in a manufacturing operation.

The EDID information of the display unit 1 is divided into the first (i.e., essential or necessary) EDID information and the second (i.e., optional, unnecessary or non-essential) EDID information at operation 21.

For example, the first EDID information comprises detailed information such as an EDID header and a signal sequence and the second EDID information comprises a name of a manufacturer, a code, a version of the EDID information and a color characteristic as the common second (i.e., optional, unnecessary or non-essential) EDID information and a manufacturing date, a serial number of a product, a checksum byte as the particular second (i.e., optional, unnecessary or non-essential) EDID information. However, the EDID information may vary by manufacturer.

The first EDID information is stored in the non-changeable memory 3 at operation 22 and the second EDID information is inputted from the computer main body 11 and stored in the RAM 9 to store the second EDID information in the changeable memory 5 at operation 23.

The controller 7 combines the first EDID information stored in the non-changeable memory 3 and the second EDID information stored in the RAM 9 and checks for errors of combined EDID information at operation 24. The errors of the bytes are checked by whether a result of an addition is equal to 0. That is, if adding the combined EDID information in each unit does not cause an overflow at operation 25, then no error is determined to have occurred.

If an error is detected, the second EDID information stored in the RAM 9 is considered to have the error and only the first EDID information stored in the non-changeable memory 3 is supplied to the computer main body 11. The controller 7 stores the first EDID information in the RAM 9 and makes the computer main body 11 read the second EDID information at operation S6.

If no error is detected, the EDID information stored in the RAM 9 is stored in the changeable memory 5. Storing the EDID information in the display unit 1 is completed at operation 27. Thereafter, the process may be continued to determine whether correct EDID information is stored in the changeable memory 5 at operations 28 to 31.

The controller 7 re-initializes the RAM 9 at operation 28 and checks error by combining the EDID information stored in the non-changeable memory 3 and the changeable memory 5 at operations 29 and 30.

If an error occurs, the controller 7 supplies the first EDID information to the computer main body 11 by storing the EDID information stored in the non-changeable memory 3 in the RAM 9 for the display data channel (DDC) at operation 26. If no error is checked, the controller 7 stores an entire combined EDID information in the RAM 9 to operate the display data channel (DDC) operation and supplies the EDID information to the computer main body 11 at operation 31.

The first EDID information is stored in the non-changeable memory 3 during the manufacturing operation, so that the EDID information stored in the changeable memory 5 is decreasable and a period for manufacturing the display unit 1 is decreased. The common second EDID information among second (i.e., optional, unnecessary or non-essential) EDID information may be stored in the unchangeable memory 3. If an error is detected, the second EDID information is storable in the changeable memory 5 again, so that the display unit 1 may have correct information.

Figure 3:
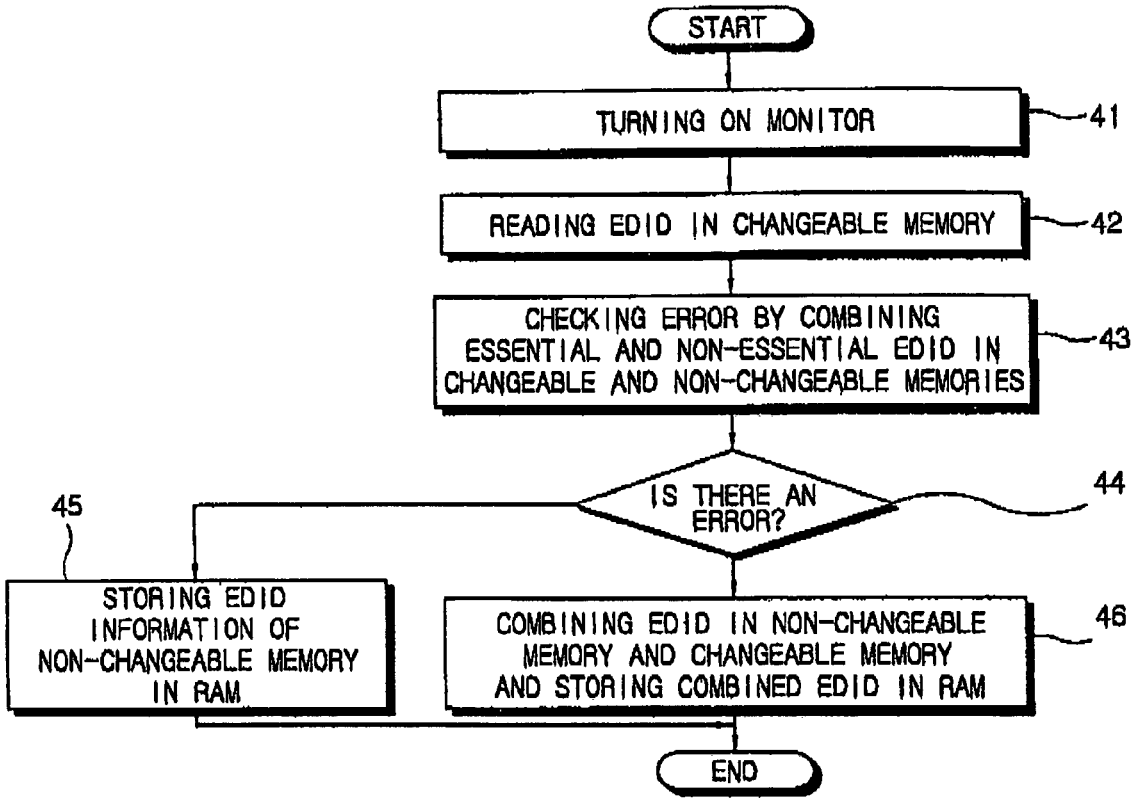
FIG. 3 is a flow chart of a control operation for a display unit according to a third embodiment of the present invention.

FIG. 3 is a flow chart of a control operation for the display unit according to a third embodiment of the present invention.

When a user turns on the display unit 1 at operation 41, the controller 7 reads out the EDID information stored in the changeable memory 5 and checks for errors by combining the EDID information stored in the changeable memory 5 with the EDID information stored in the non-changeable memory 3 at operations 42 and 43. The errors are checked in a common manner as in the manufacturing operation at operation 44.

If an error is detected, the controller 7 stores the EDID information including the first EDID information stored in the ROM (i.e., changeable memory 3) in the RAM 9 for a DDC protocol and supplies the EDID information to the computer main body 11. Thus, although the error occurs because of an error in data in the changeable memory 5 or an error occurred when reading the data, video information is displayable on the display unit 1.

If no error is detected, the controller 7 combines the EDID information stored in the non-changeable memory 3 and the changeable memory 5 and stores the combined EDID information in the RAM 9 for the DDC protocol to supply the combined EDID information to the computer main body 11 at operation 46.

When the computer main body 11 is booted, an operating system (OS) reads out the EDID information stored in the RAM 9 for the DDC protocol and installs a driver to operate the display unit 1.

FIGS. 2 and 3 shows embodiments in which the non-changeable memory 3 stores only the first EDID information (i.e., only the essential or necessary EDID information). However, the common second (i.e., common optional, unnecessary or non-essential) EDID information may be stored in the non-changeable memory 3.

The use of the non-changeable memory 3 should be considered since the memory capacity is limited. Since the ROM, which is the non-changeable memory 3, has a limit in a memory capacity thereof, a portion of other information, such as information about brightness and contrast, should be stored in the EEPROM of the display unit 1, as well as storing portions of the EDID information in the EEPROM.

The EDID information may have data both for analog and digital video signals, because the EDID information has different data according to a type of the video signal. In this case, the manufacturing process shown in FIG. 2 should be repeated for both of the analog and digital data.

According to the present invention, a period for manufacturing a display unit may be reduced and the display unit may display video information, if an error occurs in the EDID information stored in the EEPROM.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A control method of a display unit in which a video signal is supplied by an external device to display the video signal, the control method comprising:

dividing extended display identification information of the display unit into essential extended display identification information that is required to display the video signal and non-essential extended display identification information which is exclusive of the essential extended display identification information;

storing the essential extended display identification information in a non-changeable memory and at least a part of the non-essential extended display identification information in a changeable memory;

detecting an error of the extended display identification information stored in the changeable memory and the non-changeable memory; and supplying the extended display identification information stored in the non-changeable memory to the external device, if the error is detected.

2. The control method of a display unit according to claim 1, further comprising:

dividing the non-essential extended display identification information into a common non-essential extended display identification information that is common in display units having a common specification and particular non-essential extended display identification information that is particular for each of the display units, the common non-essential extended display identification information being stored in the non-changeable memory.

3. The control method of a display unit according to claim 1, further comprising supplying all of the extended display identification information stored in the non-changeable memory and the changeable memory to the external device, if no error is detected.

4. The control method of a display unit according to claim 1, wherein the non-changeable memory is a read only memory and the changeable memory is an electrically erasable programmable read only memory.

5. A display unit in which a video signal is supplied by an external device to display the video signal, the display unit comprising:

a non-changeable memory to store essential extended display identification information that is required to display the video signal;

a changeable memory to store at least a part of non-essential extended display identification information exclusive of the essential extended display identification information; and a controller to determine whether the extended display identification information stored in the non-changeable memory and the changeable memory, respectively, has an error and supplying the extended display identification information stored in the non-changeable memory to the external device, if the error is detected.

6. The display unit according to claim 5, wherein the non-changeable memory stores a common non-essential extended display identification information common in display units having a common specification among the non-essential extended display identification information.

7. The display unit according to claim 5, wherein the controller supplies all of the extended display identification information stored in the non-changeable memory and the changeable memory to the external device, if no error is detected.

8. The display unit according to claim 5, wherein the non-changeable memory is a read only memory and the changeable memory is an electrically erasable programmable read only memory.

9. A display unit having a video signal input thereto to display the video signal, comprising:

non-changeable and changeable memories; and a controller to control a storage and a reproduction from the non-changeable and changeable memories, the non-changeable memory being provided to store and reproduce first extended display identification information, which is essential to display the video signal, and changeable memory being provided to store and reproduce at least a part of the second extended display identification information, which is not essential to display the video signal, and to determine whether the extended display identification information stored in the non-changeable and changeable memories has an error; and to output the extended display identification information stored in the non-changeable memory, if the error is detected.

10. A display unit having a video signal input thereto to display the video signal, comprising:

a non-changeable memory to store and reproduce first extended display identification information, which is essential to display the video signal and a part of second extended display identification information, which is common among display unit having a common specification and which is not essential to display the video signal;

a changeable memory to store and reproduce a remaining part of the second extended display identification; and a controller to determine whether the first extended display identification information and the part of the second extended display identification information stored in the non-changeable memory and the remaining part of the second extended display identification information stored in the changeable memory, respectively, has an error and supplying the first extended display identification information and the part of the second extended display identification information stored in the non-changeable memory to the external device, if the error is detected.

* * * * *

UNITED STATES PATENT AND TRADEMARK OFFICE

CERTIFICATE OF CORRECTION

PATENT NO. : 7,414,619 B2
APPLICATION NO. : 10/929679
DATED : August 19, 2008
INVENTOR(S) : Young-chan Kim It is certified that error appears in the above-identified patent and that said Letters Patent is hereby corrected as shown below:

Column 8, Lines 21-22, after “specification” insert --,--.

Column 8, Line 25, change “identification;” to --identification information;--.

Signed and Sealed this

Eleventh Day of November, 2008

JON W. DUDAS
*Director of the United States Patent and Trademark Office*